United States Patent [19]

Homolik

[11] 4,455,995

[45] Jun. 26, 1984

[54] HEATING STOVE WITH HEAT REGULATING SYSTEM

[76] Inventor: Matthew W. Homolik, 2390 Ransell Rd., Merrifield, Va. 22116

[21] Appl. No.: 396,898

[22] Filed: Jul. 9, 1982

Related U.S. Application Data

[63] Continuation-in-part of Ser. No. 181,477, Aug. 26, 1980, Pat. No. 4,361,131.

[51] Int. Cl.[3] ..... F24B 7/00

[52] U.S. Cl. ..... 126/123; 126/61; 126/66; 126/80; 126/290; 126/312; 98/48

[58] Field of Search ..... 126/312, 307 R, 84, 126/123, 67, 77, 120, 290, 121, 83, 287, 80, 146; 98/46, 47, 48; 110/160; 237/52, 53

[56] References Cited

U.S. PATENT DOCUMENTS

| | | | |
|---|---|---|---|
| 1,200,201 | 10/1916 | Kreatz | 126/121 |
| 2,362,940 | 11/1944 | Skerritt | 237/52 |
| 2,515,869 | 7/1950 | Gregg et al. | 126/287 |
| 2,703,567 | 3/1955 | Manchester et al. | 126/67 |
| 3,171,399 | 3/1965 | Kirgan | 126/67 |
| 4,127,100 | 11/1978 | Baker | 126/61 |
| 4,180,052 | 12/1979 | Henderson | 126/108 |
| 4,184,473 | 1/1980 | McIntire et al. | 98/48 |
| 4,201,185 | 5/1980 | Black | 126/77 |
| 4,204,517 | 5/1980 | Rumsey | 126/63 |
| 4,300,526 | 11/1981 | McKay et al. | 126/77 |
| 4,329,976 | 5/1982 | Jackson | 126/312 |
| 4,361,131 | 11/1982 | Homolik | 126/123 |

FOREIGN PATENT DOCUMENTS

| | | | |
|---|---|---|---|
| 242292 | 7/1960 | Australia | 126/67 |
| 1041223 | 9/1966 | United Kingdom | 237/55 |

*Primary Examiner*—James C. Yeung

*Attorney, Agent, or Firm*—Kerkam, Stowell, Kondracki & Clarke

[57] ABSTRACT

A circulating air wood burning heating stove/fireplace combination has a combustion chamber that is in the form of a shell defined by inner walls of the stove and a rearwardly disposed air outlet manifold. Spaced outer auxiliary back and top walls and the corresponding shell walls form therebetween air passages through which ambient air is recirculated into the room over the manifold. The manifold is provided with a plurality of spaced heat conductive metal strips disposed about its periphery. Several manifold embodiments include one or more finned air heating conduits which extend therethrough. A blower fan or pair of blower fans are used to circulate air through the air passages and in heat transfer relationship to the manifold. A valve, damper, and linkage control arrangement regulate the heat output and may be used upon starting of the fire to clear a column of cold air from the flue.

8 Claims, 21 Drawing Figures

FIG. 7.
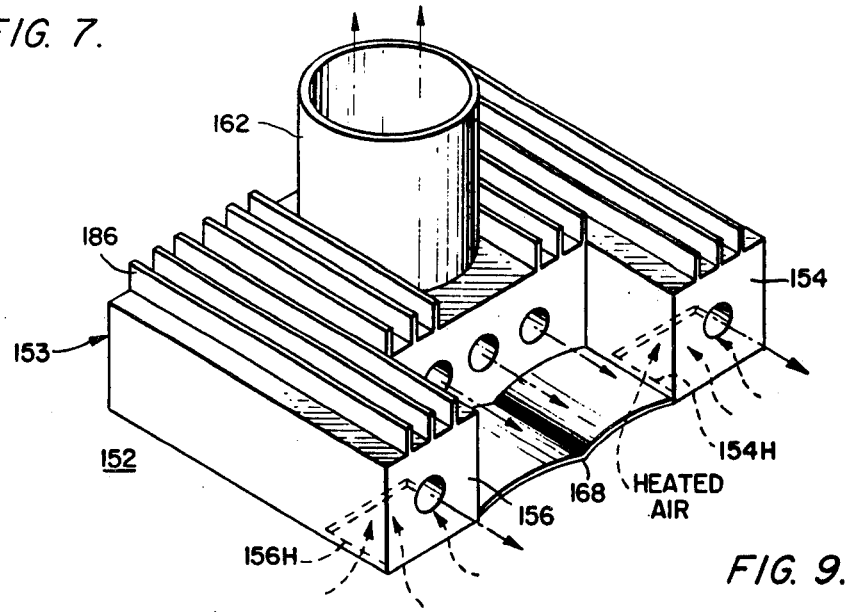
FIG. 8.
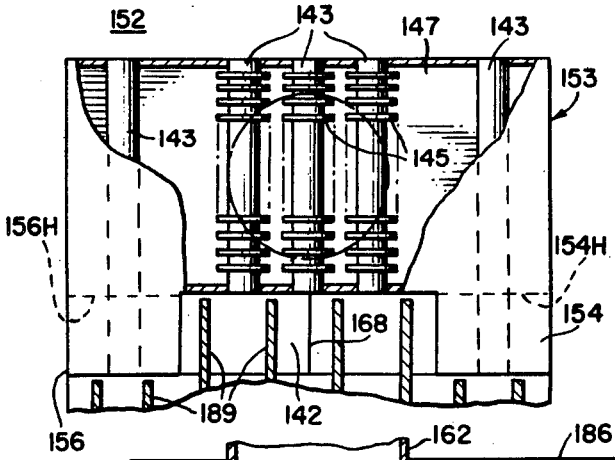
FIG. 9.
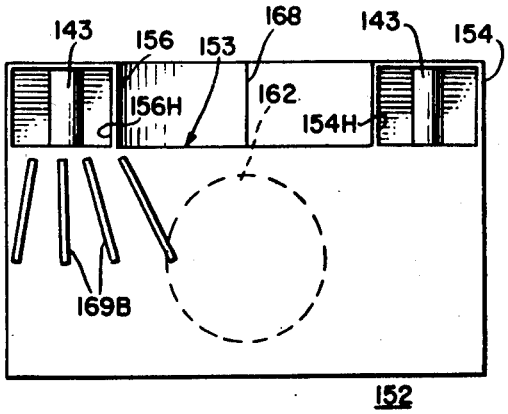
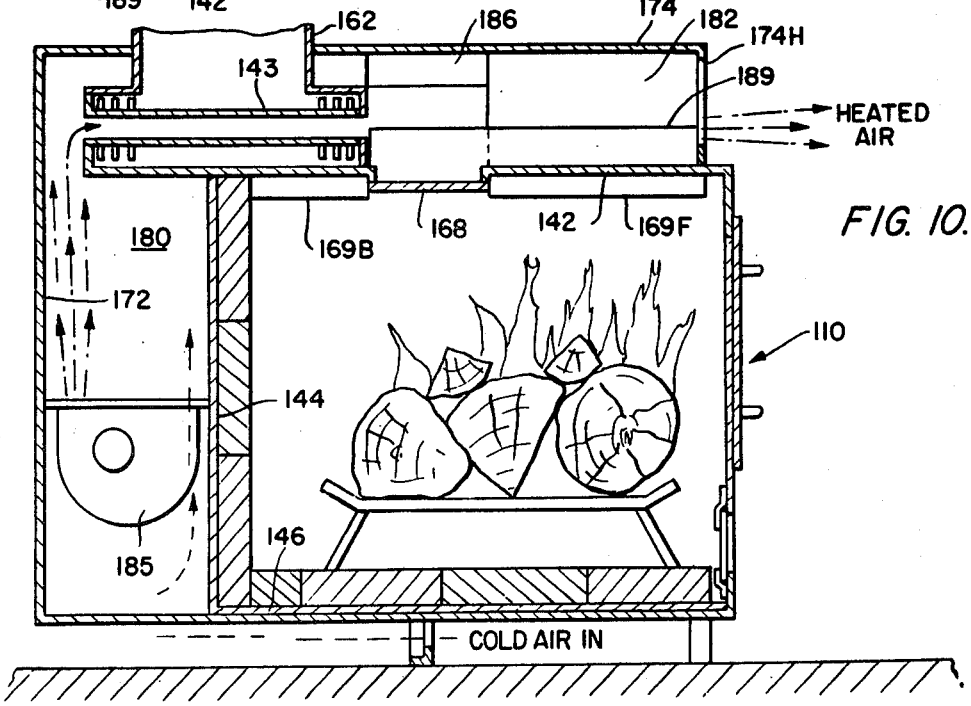
FIG. 10.

HEATING STOVE WITH HEAT REGULATING SYSTEM

CROSS-REFERENCE TO RELATED APPLICATIONS

The present application is a continuation-in-part application of the present inventor's U.S. copending application Ser. No. 181,477 filed Aug. 26, 1980, now U.S. Pat. No. 4,361,131, issued Nov. 30, 1982 and titled "Circulating-Air Heating Stove with Exit Air Heat Extractor". Another continuation-in-part application based on Ser. No. 181,477, claiming subject matter disclosed in this application, has been filed on July 9, 1982 as U.S. Ser. No. 396,897 under the title "Woodburning Heating Stove and Heat Extractor".

BACKGROUND OF THE INVENTION

With the advent of central heating systems and abundantly available and relatively inexpensive fossil fuels, old-fashioned "pot-bellied" stoves which formerly were used to provide heat have fallen into disuse. Central heating systems offer a distinct advantage over individual heating stoves located in each room which a person desires to heat. Furthermore, central heating systems can be hidden away out of view from the rooms in which they supply heat. In addition, such systems, even coal fired systems, are relatively easy to clean and to maintain. As a consequence, up until recently, there has been little interest in wood burning heating stoves, particularly those which are located within the room which is to be heated. This has been true even for remote cabins or cottages since bottled gas or petroleum fuels have been available in abundant quantities for use with the heating plans of such buildings.

At the present time, however, it is becoming abundantly clear that the fossil fuels which have been used to such a great extent over the past few decades are in dangerously short supply. Furthermore, these fuels are obtained from nonreplenishable sources; and at the present rate of consumption, it is readily apparent that other alternatives to the use of these fuels for producing energy must be found. In addition, the costs of fossil fuels have rapidly risen, so that they no longer are the bargain source of energy which they were only a few years ago.

Because of increasing awareness of the finite quantity of fossil fuels available and because of the increasing costs of these fuels, substantial interest is being directed toward finding other sources of energy to replace the fossil fuel consumption which has become so widespread over the past few decades. One source of fuel which is present in large quantities and which is a replenishable source is wood. When forests are properly managed, they produce a continuous supply of wood for various uses, one of which is fuel.

Thus, there now is an increasing interest in wood burning stoves for heating small buildings and remotely located buildings as well as interest in using wood burning stoves in applications where presently fossil fuel central heating systems are commonly employed or as a supplement to existing systems. The wood burning stoves commonly employed, however, generally are extremely inefficient as heating sources. Most of them rely upon radiation and convection currents of air within the room coming into contact with the outside walls of the stove to produce heated air. In such stoves the major portion of the heat produced by the combustion of the wood or other combustible products in the stove is lost with the combustion products out the flue or smoke stack. This is one of the greatest drawbacks of self-contained room size wood burning stoves. In addition, the room itself is not uniformly heated. The region immediately adjacent the stove is too hot, while the more remote corners or sides of the room obtain relatively little heat from the stove.

Some early models of wood burning heating stoves, in attempts to overcome the inefficiency of such stoves, relied upon rather extensive baffles between the upper portion of the combustion chamber and the outlet for the flue in order to force the combustion products to take a tortuous path from the upper portion of the combustion chamber to the flue. This resulted in retention of more heat within the stove and an improvement in radiation of this heat from the stove. The operation, however, is still relatively inefficient and a large amount of heat loss results due to hot air passing out the flue.

To improve these early wood burning stoves resort was made to a double wall along at least a portion of the fire chamber to create an air chamber heated on one side by one of the walls of the fire chamber. An air inlet was provided near the bottom of this air chamber and appropriate air outlets were created near the top. Air rose by convection current through the air chamber and out the outlets. Thus, this air was heated in addition to the air coming in contact with the outside of the stove. To improve efficiency still further, fans or blowers were employed to draw air through the air chamber and over the outer walls of the fire chamber. While the fans did provide improved efficiency, the bulk of the heat generated by the process of combustion still was lost in the flue, as could be evidenced by the fact that the flue pipe of an operating stove is generally too hot to touch.

Another common problem with wood burning stoves is that they may allow smoke to escape into the room or rooms which are being heated, especially when initially starting a fire in the stove. At start up there is often a column of cold air in the flue or chimney. This cold air blanket may initially impede the flow of combustion gases out the flue, causing a back pressure of combustion gases which may then escape into the room.

A problem other than cold air induced backflow is often encountered on start-up. Specifically, a fan, which is used to circulate air through the heating stove, will cause cold air to blow around the room until the stove has enough heat to heat the air circulated by the fan. Accordingly, this problem is often avoided by turning the fan on (either manually or by a thermostatic switch) only after the stove is sufficiently heated to heat the air circulated by the fan. However, this creates an undesirable delay between the starting of a fire and the beginning of heated air flow from the stove.

In addition to the foregoing disadvantages, most wood burning stoves are rather obtrusive and unattractive. It is desirable to provide a wood burning stove with an appearance approximately that of a fireplace and useable as a fireplace so that it can perform a function of attractiveness as well as utility in the room in which it is used. In addition, it is desirable to provide a wood burning stove with improved efficiency, so that the greatest portion of the heat generatead by the wood or other fuel burned in the stove is utilized to heat the room within which the stove is used.

SUMMARY OF THE INVENTION

Accordingly, it is an object of this invention to provide an improved heating stove or space heater.

It is another object of this invention to provide an improved heat extractor for a heating unit.

It is an additional object of this invention to provide an improved wood burning heating stove utilizing recirculating air flow therethrough.

It is a further object of this invention to provide an improved wood burning heating stove which may be used as a stove or as a fireplace.

It is yet another object of this invention to provide an improved efficiency heat extractor adapted to be disposed to recapture heat which would otherwise escape through the flue of a heating system.

A further object of this invention is to provide a wood burning stove which minimizes or avoids any tendency to have combustion gas backflow.

A still further object of this invention is to provide a wood burning stove which can output heat with little or no delay after the start of the fire.

In accordance with a preferred embodiment of the invention, a heating stove includes a combustion chamber having front, back, top, bottom and side walls; an outer shell at least partially enclosing the combustion chamber including an auxiliary back wall spaced from the back wall to provide a first rearward airspace between the back wall and the auxiliary back wall for passage of air to be heated, and an auxiliary top wall spaced from the top wall to provide a second air space between the top wall and the auxiliary top wall for passage of heated air into a room to be heated; and a heat extracting manifold for transferring heat from combustion gases to air. The stove further includes a blower for blowing air to flow in heat transfer relationship with the heat extracting manifold; a hot air outlet allowing heated air to exit from the wood burning stove; a flue outlet for allowing combustion gases to pass to a flue; and control means for causing a flue clearing portion of air proceeding out the flue to minimize any back flowing of combustion gases which might otherwise be caused by a column of cool air in the flue. The heating stove further includes a valve controlled by the control means and wherein the opening of the valve by operation of the control means allows at least some air blow by the blower to proceed out said flue outlet.

BRIEF DESCRIPTION OF THE DRAWINGS

FIG. 7 is a perspective view of a third embodiment of a heating extracting manifold.

FIG. 8 is a bottom view in partial break-away of the manifold of FIG. 7.

FIG. 9 is a top view of the manifold of FIG. 7.

FIG. 10 shows the manifold of FIG. 7 in place in a wood burning stove.

DETAILED DESCRIPTION OF THE INVENTION

Figure 1:
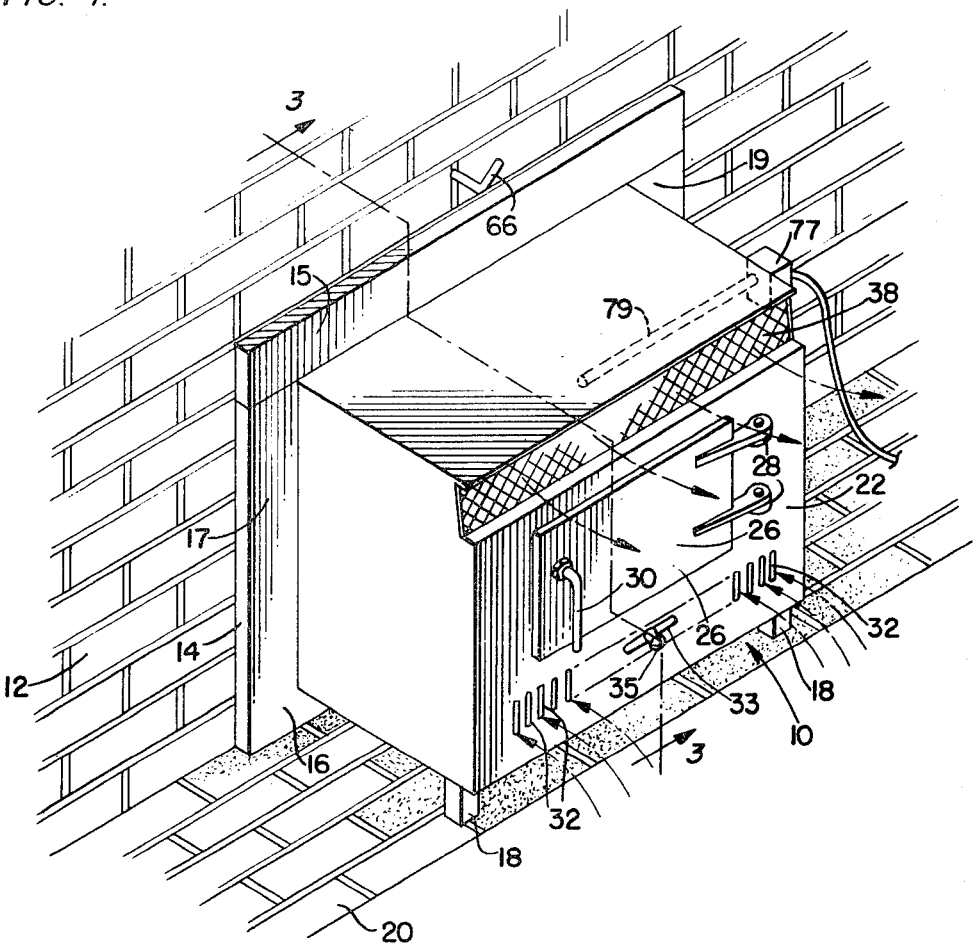
FIG. 1 is a perspective view of an embodiment of the invention shown as mounted directly into a conventional fireplace opening.

Referring now to the drawings, wherein like reference characters are used to represent like elements throughout the several views, FIG. 1 is a perspective view of a preferred embodiment of space heater in accordance with the present invention which may be either of a free standing variety or used in combination with an existing fireplace.

In FIG. 1, the wood burning stove or space heater 10 is shown in use with an existing fireplace and is mounted in the suitable opening in fireplace wall 12 which is closed off by decorative frame member 14 made up of horizontal cross pieces 15 and 16 and vertical pieces 17 and 19. Frame member 14 has a rectangular opening corresponding to the outer dimension of stove 10 so that stove 10 may be conveniently positioned therein when used in conjunction with an existing fireplace opening. To this end, the bottom of the stove 10 may rest on the top edge of horizontal cross piece 16 of decorative member 14, while two front foot members 18 at the front corners of stove 10 serve to maintain the stove level with respect to hearth 20. Stove 10, as shown in FIG. 1, extends substantially from the fireplace opening covered by decorative member 14. However, it will be readily appreciated that stove 10 can be inserted substantially its entire length into the fireplace opening, depending upon the depth of the fireplace, and if necessary, stove 10 may include additional foot stabilizing members at the rear thereof so that the stove may be free standing and used apart from a fireplace.

The front wall 22 of stove 10 includes a large rectangular opening 24 defined therein (as shown most clearly in FIG. 3) which is adapted to be closed by door 26. The opening 24 provides ready access to the interior of the combustion chamber 11 to permit the loading of wood or other fuel into the combustion chamber and to permit the removal of residual products of combustion and the cleaning of the combustion chamber from time to time. Door 26 is conveniently pivotally hinged at one side of the opening to the front wall 22 by hinges 28. At the other side of door 26 there is provided a handle 30 which preferably is of non-conductive material or includes an insulative portion to minimize the possibility of one getting burnt when handling the door during operation of the stove.

Below door 26 there is provided a plurality of spaced draft openings 32 which extend along a common line and which open into the front interior of combustion chamber 11. Draft openings 22 allow fresh air, as shown by arrows in FIG. 1, to be drawn into the combustion chamber 11. To control the draft, a slide 34 (shown in FIG. 3) is disposed behind slots 32. Slide 34 may be provided with spaced slots (not shown) adapted to be aligned with slots 32 to permit communication between the combustion chamber and outside of the stove when the slots are aligned. To this end, slide 34 includes a gripping handle or knob 35 which extends through slot 33. Slide 34 is slidingly supported within support cleats 36 welded to the inside surface of wall 22. Other draft configurations may likewise be used. For example, slide 34 may be disposed on the exterior of front wall or may be circular in shape, it only being necessary that a convenient means be provided to allow draft air to enter into the combustion chamber and to control the amount of draft air thus entering. The amount of air permitted to enter the combustion chamber when a unit 10 is used as a heating stove or space heater is controlled by the extent of opening of the draft slots and the slide should be capable of maintaining the slots fully closed, fully open or at some intermediary position.

The combustion chamber 11 is defined by base 40, top wall 42, front wall 22, rear wall 44 and side walls 46 and 48. To prevent excess heat from being radiated from the bottom of sotve 10, refractory brick or other suitable refractory material 50 is used to line the bottom of the stove and the lower portion of the side walls and back walls. The use of the refractory material 50 permits the stove unit to be built as a low profile unit which may be placed on or very near the floor of the room in which the stove is used.

Figure 2:
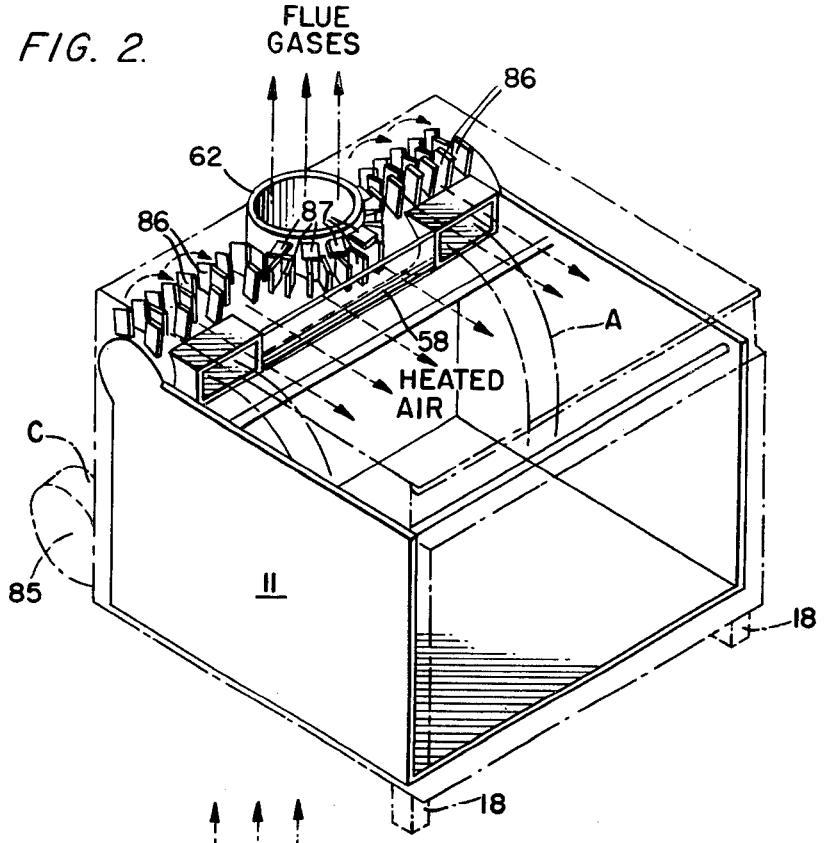
FIG. 2 is a diagrammatical perspective view of an embodiment of the invention with the outer walls shown in phantom and illustrating the direction of flow of the input cold air, heated air and flue or combustion gas.
Figure 4:
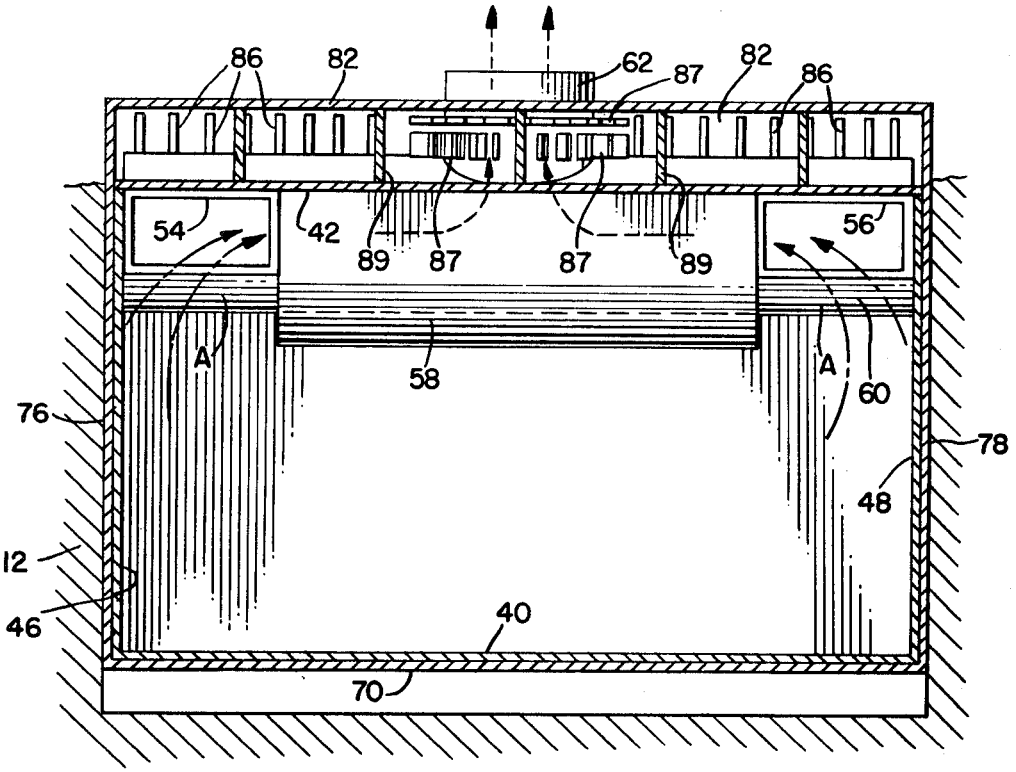
FIG. 4 is a front elevational view taken along lines 4—4 of FIG. 3 with the grate and wood burning logs removed for clarity
Figure 5:
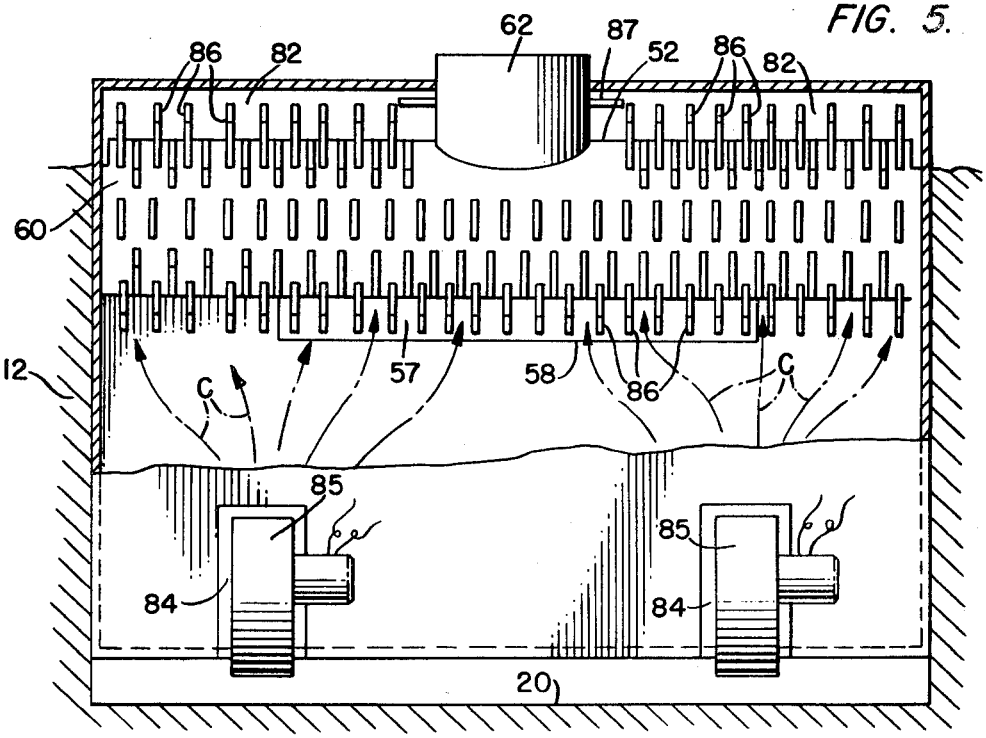
FIG. 5 is a rear elevational view taken along lines 5—5 of FIG. 3.

In accordance with the present invention, as shown in FIGS. 4 and 5, the top wall 42 and back wall 44 of the shell or combustion chamber, which would normally meet at the upward rear corner in a conventional stove, are terminated short of the corner to accommodate an air or combustion products exit manifold 52. Manifold 52 extends across the entire width of the combustion chamber and has its opposite ends suitably affixed to the side walls 46 and 48 and to top wall 42 and back wall 44 by welding or the like. Manifold 52 includes a pair of inlet openings 54 and 56 disposed at opposite sides of the manifold and adapted to provide inlet passages for combustion products. Openings 54 and 56 are shown in FIGS. 2 and 4 as rectangular or box shaped conduits which extend out a short distance from the manifold surface. Between conduits 54 and 56 is welded a curved air deflection plate member 58 which is slightly spaced from the front and lower peripheral surface 60 of manifold 52. Plate member 58 may be welded at its sides to the sides of the conduits 54 and 56 and its bottom end to the top of back wall number 42 to establish a lower air passage 57 about manifold 52, an upper air passage 59 being defined by a portion of an auxiliary back wall 72 and a portion of an auxiliary top wall 76 and the back and upper surface of the manifold.

Manifold 52 is provided with an exit opening or circular pipe conduit 62 disposed centrally thereof and adapted to be connected to a flue 64. Flue 64 may include a conventional damper mechanism 66. Within the combustion chamber 11 and immediately in front of the manifold 52 and extending across the width of the chamber is a baffle 68. Baffle 68 extends downwardly from top wall 42 and is sloped at an angle towards the rear wall 44. Baffle 68 is designed to create a turbulence and to provide a tortuous path for the combustion products within fire chamber 11 as shown by the arrows A in FIG. 3 so as to prevent the combustion gases or products from escaping directly through the inlet openings 56 and 58 of the manifold which, as viewed from the front of the stove, are disposed behind the baffle and at opposite sides of the fire chamber.

The combustion chamber of shell 11 and the manifold 52 which is an integral part thereof are disposed within an outer stove housing comprising a bottom support wall 70, an auxiliary rear wall back wall 72, an auxiliary top wall 74 and side walls 76 and 78. The auxiliary back wall 72 is spaced from shell back wall 44 to form an air chamber therebetween. Auxiliary top wall 74 is spaced from shell top wall 42 to form an air space therebetween. The two air spaces 80 and 82 are in communication with each other through air passages 57 and 59 so as to form a continous passage. One or more air inlets 84 are provided in the lower portion of auxiliary back wall 72 and a suitable air or blower motor 85 is conveniently supported at each air inlet to draw air into the air passage. As shown by arrows B and C in FIG. 2 and 3, cold air is drawn from below and behind stove 10 through inlet 84 and is directed upwardly through the air passage 80 over and under the manifold through passages 57 and 59 to air space 62.

It will be noted that the air drawn into the air chambers shown by arrows B is cold air which is heated as it passes over manifold 52. To this end, manifold 52 is provided with a plurality of heat conducting fins 86. The fins are in the form of heat conductive strips arranged along the periphery of the manifold and extending outwardly therefrom. The strips 86 are disposed radially with their flat planar surfaces arranged parallel to a vertical plane and in the path of air movement to provide a minimum interference with air flow, but maximum planar surface for heat transfer. Spaced heat extractor strips 87 are also positioned on pipe conduit 62. The heat extractor strips 87 on conduit 62 comprise at least two rows disposed about the periphery of the pipe conduit. The uppermost row has its heat strips 87 disposed in a horizontal plane (flat surfaces horizontal) and radially of th epipe conduit while in the lower row the heat strips are arranged at right angles with respect thereto (flat surfaces vertical). As the air comes up and over the heat strips, the heat strips of the lowermost row present a minimum of interference with the air flow while the uppermost row helps to deflect the air and redirect the air at right angles into the air chamber formed between walls 42 and 74, while still presenting a maximum surface for heat exchange purposes. The strips are approximately $1 \times 2\frac{1}{2} \times \frac{1}{8}$ inches spaced about one inch apart, and because of the great number thereof provide a relatively large cross section area of heat conductive metal for rapid extraction of heat from flowing combustion products. For example, on conduit 62, in a practical embodiment, forty eight strips or heat vanes were placed around the outlet conduit and 107 strips can be used depending on available surface area.

As should be apparent, in operation, wood logs or other suitable fuel 88 may be positioned and burned on a grate 90 disposed in the fire chamber 11. The combustion gases A rising from the burning fuel is caused, by virtue of baffle 68, to take a tortuous path finally passing under and about baffle 68 and into the air inlets 54 and 56 of manifold 52. The hot combustion products cause the manifold to be heated which heat is transferred to the cold air C through exterior strips 82 disposed about the periphery of the manifold 52 and strips 87 disposed about the periphery of the pipe conduit 62. The heat extracted from the combustion gasses is the heat that would normally flow with the flue gasses up the chimney and otherwise be wasted.

Additional heat transfer means in the form of longitudinal heat transfer plates 89 welded to the top wall 42 may be provided. These strips may have a plurality of openings 91 along the length and may be arranged at an angle with respect to the longitudinal axis to intercept the air flow, the openings 89 allowing air to pass through. In this way, a plurality of internal passages are formed in air space 84 with maximum exposure of metal to the air flow for maximum heat transfer.

A thermostat 71 may be provided to monitor the temperature of the air space entering the room to be heated with suitable control means responsive to monitor the temperature to control operation of the fan so as to reduce air circulation in the event of excessive heat. While the thermostat is shown positioned with its monitoring element 79 in air space 84, it should be apparent that thermostat 77 may be mounted anywhere in a room to be heated so as to monitor room temperature.

Figure 6:
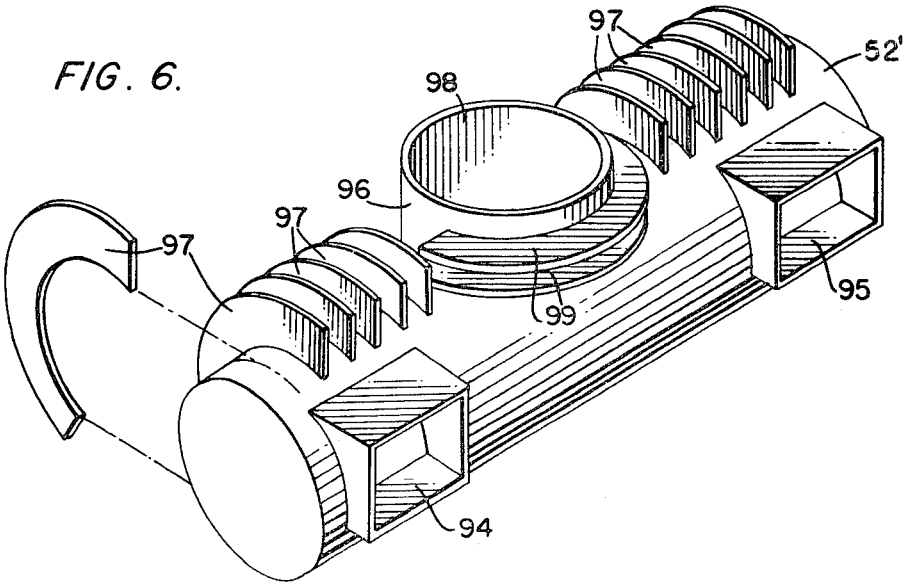
FIG. 6 is a perspective view of a second embodiment of heat extracting manifold for use in accordance with the present invention wherein the heating extracting strips are curved strip members affixed to the outer peripheral surface of the manifold and exit pipe.

Referring to FIG. 6, there is illustrated an alternate embodiment of manifold 52'. As in the case with the previously described embodiment, manifold 52' comprises a main cylindrical conduit comprising shell 93 closed at its opposite ends and having two inlet conduits 94 and 95 adapted to face into the combustion chamber. An outlet conduit 96 disposed between inlet conduits 94 and 95 provides an exit opening 98 adapted to be connected to the flue. Disposed about the periphery of the surface of the shell are a plurality of semicircular heat conducted strips 97. Similar semicircular heat conductive strips 99 are disposed about the outlet conduit 96. The strips 97 and 99 are arranged in spaced relationship to, in effect, provide a plurality of channels through which the cold input air passes and extracts heat from the strips. Although the strips 97 and 99 are shown only on the back surface of shell 93 and front surface of conduit 96, it should be apparent that for maximum heat transfer the strips can be positioned on both sides, i.e. all around the shell and conduit.

Turning now to FIGS. 7, 8, and 9, there is shown respectively a perspective view, a top view in partial breakaway, and a bottom view of a third embodiment of a heat extracting manifold according to the present invention. The manifold 152 includes a body portion 153 having right and left inlet projecting portions 154 and 156 respectively. Inlet projecting portions 154 and 156 are disposed adjacent opposite respective first and second ends of the body portion 152. Both inlet projecting portions 154 and 156 project out forwardly from the body portion 153 and include first and second inlet holes 154H and 156H respectively, which holes face in the same direction (downwardly).

Combustion gases may enter the holes 154H and 156H and pass through the interior cavity 147 to the outlet conduit 162 in the same essential manner as previously described with respect to the heat extracting manifolds 54 and 54'. However, the manifold of FIGS. 7–9 is more efficient than the previous manifolds due to the passage of air through air heating conduits 143, which conduits pass through the interior cavity 147 of the manifold body 153. The air heating conduits 143 may include a number of heat conducting fins 145 which may extend completely across each conduit 143 or alternately, as shown in FIG. 8, may only be located at the ends of the conduits 143 so as to facilitate the flow of combustion gas from inlet holes 154H and 156H to the centrally disposed outlet conduit 162. The air heating conduits 143 at the right and left ends of the manifold 153 may include heat conducting fins or, alternately and as shown, may ease the flow of combustion gas by not having heat conducting fins.

Turning specifically to FIG. 10, the use of the manifold of FIGS. 7–9 is shown in conjunction with a wood burning stove 110 having top wall 142, back wall 144, bottom wall 146, auxiliary back wall 172, auxiliary top wall 174, and fan 185 will operate in essentially the same manner as the wood burning stove having either of the two previously discussed manifolds. The construction details of the FIG. 10 wood burning stove which are similar to the previously discussed wood burning stoves need not be discussed in detail, it being readily recognizable that numerous of these components operate identically to the components of the previously discussed wood burning stoves. However, the manifold 152 is different from the above-discussed manifolds in that the air heating conduits 143 extend through the interior cavity 147 of the manifold 152. Thus, in addition to air being blown from the rear air cavity 180 to the top air cavity 182 through the heat strip heat conducting fins 186 in a manner similar to the FIG. 6 heat extractor, air is also blown from the rear air cavity 180 into the top air cavity 182 by way of the heat conducting tubes 143. The use of heat conducting fins 145 on some or all of the air heating conduits 143 serves to greatly increase the heat transfer from combustion gases to the air. Note that since the air heating conduits 143 are cylinders and therefore have curved surfaces, heat transfer throughout the fin is more efficient than would be the case if the conduit 143 was square (heat flows around a curved surface more readily than a corner).

Once the hot air is blown out of the air heating conduits 143, it proceeds through the top air space 182 and out of the hole 174H into the room which is to be heated. However, as the air proceeds through the top air space 182, it may be additionally heated by contact with a number of top wall heat conducting fins 189 (also shown broken away in FIG. 8) which extend up from the top wall 142. The combustion gas would enter the manifold 152 by way of the holes 154H and 156H and proceed to the outlet conduit 162. A baffle plate 168 may be used to partially shield the holes 154H and 156H in a similar manner to the operation of baffle plate 68 in the FIG. 3 embodiment.

As shown in FIG. 10, the bottom of the manifold 152 may be integral with the top wall 142. Alternately, the manifold 152 could include a separate bottom wall.

Another feature of manifold 152 is the recessed or lowered prtion 168 (see especially FIGS. 7 and 10). This portion 168 curves up to facilitate the flow of gases towards holes 154H. Although the curved portion 168 is shown as a floor on manifold 152, it could alternately be separate from the manifold floor.

The flow of combustion gases toward the holes 154H my be further improved by including heat conductivity vanes or strips 169B and 169F on the underside of top wall 142 as shown in FIG. 10. The vanes 169B and 169F converge towards the holes 156H as shown in FIG. 9 which, for ease of illustration, shows only those vanes 169B associated with one of the holes 156H. It should be appreciated that the combustion gases will be channelized towards the holes 156H converging the front vanes 169F and back vanes 169B towards the holes 156H.

Although vanes such as 169F and 169B and curved portions such as 168 will not be shown for other embodiments of the heat extractor, the adaption of these other embodiments to include such features is contemplated as readily understood modifications to these embodiments.

Figure 11:
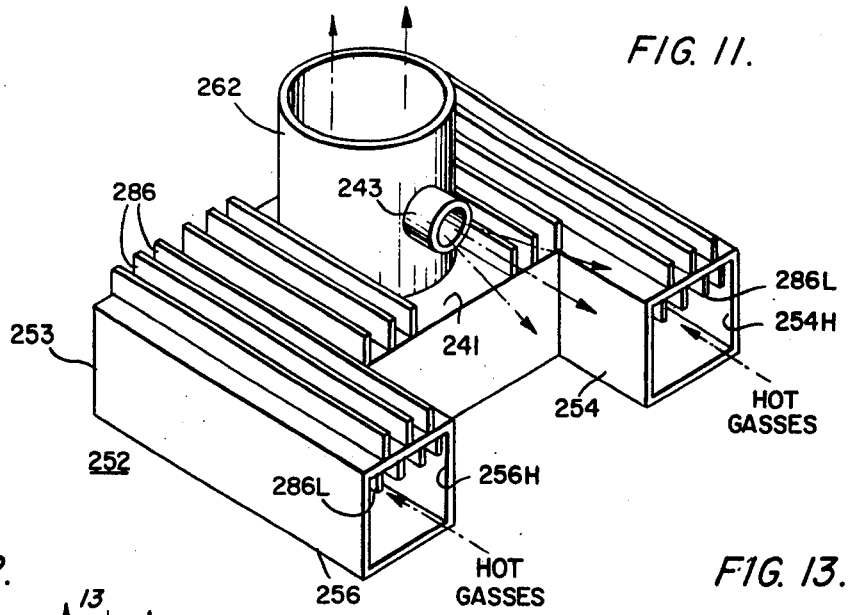
FIG. 11 shows a perspective view of a fourth embodiment of a heat extracting manifold.
Figure 12:
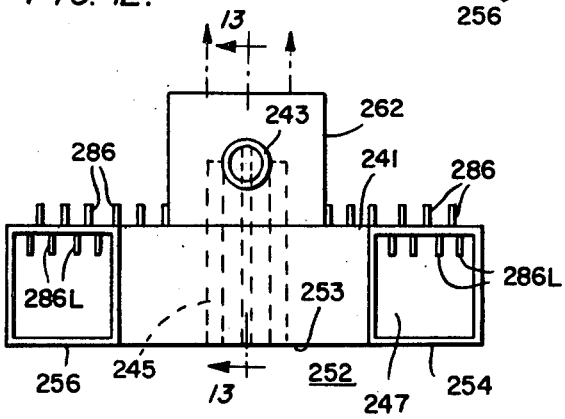
FIG. 12 shows a front view of the manifold of FIG. 11.
Figure 13:
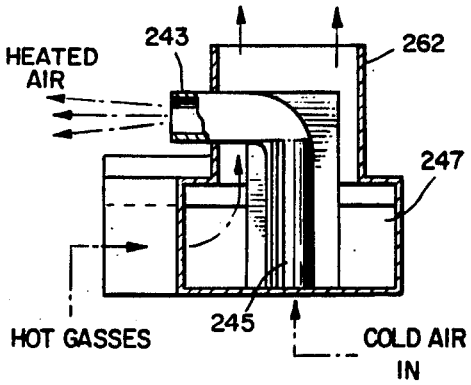
FIG. 13 shows a cross section view along lines 13—13 of FIG. 12.

FIGS. 11, 12 and 13 respectively show a perspective view, a front view, and a cross section side view of a fourth embodiment of a heat extractor. The cross section view of FIG. 13 is taken along lines 13—13 of FIG. 12. The heat extracting manifold 252 includes a body portion 253 and a right and left inlet projecting portions 254 and 256 respectively. The inlet projecting portions 254 and 256 include corresponding inlet holes 254H and 256H, both of which face forward. The planar top wall 251 of the manifold 252 has a number of heat conducting strip fins 286 mounted thereupon. Additionally, the under side of the upper wall 241 which is disposed within the interior cavity 247 includes a number of heat conducting strip fins 286L. The heat conducting fins 286L are preferably curved to channelize or conduct the combustion gases from the holes 254H and 256H to the outlet conduit 262 in a manner best shown with respect to similar heat fins 486L in FIG. 16 to be discussed later.

As best shown in FIG. 13, an air heating conduit 243 extends from the bottom of manifold 252 through the interior cavity 247 and partially within the outlet conduit 262 before exiting at the front thereof. The air heating conduit 243 includes a number of heat conducting fins 245 which are spaced circumferentially around 243 and extend vertically as shown.

Figure 3:
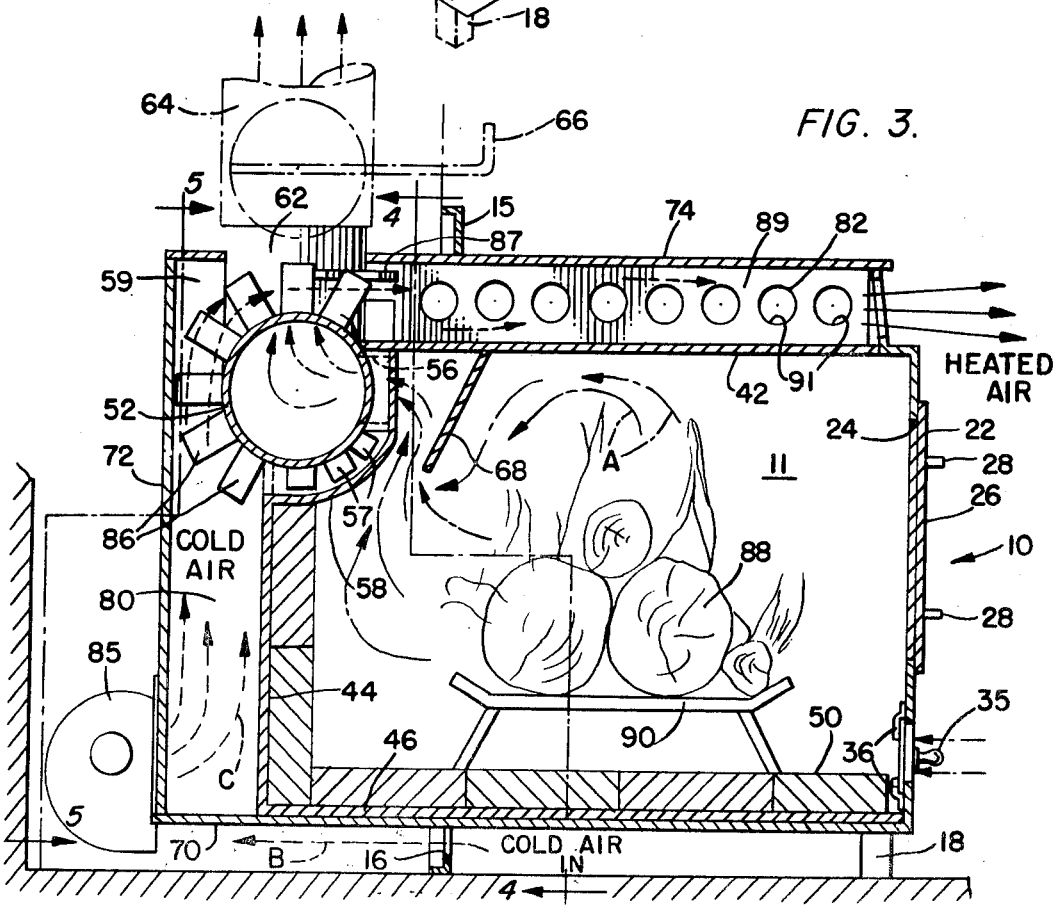
FIG. 3 is a side elevational view taken along lines 3—3 of FIG. 1

The operation of the manifold of FIGS. 11–13 and the manner of installing it as part of a wood burning stove similar to the wood burning stoves of FIGS. 3 and 10 will be readily apparent. However, it is briefly noted that the holes 254H and 256H would be installed against the back wall of a combustion chamber such that hot gasses may enter these holes and in turn exit the outlet conduit 262. Additionally, the placement of the manifold 252 will be such that cold air from the rear air space (e.g., 80 of FIG. 3 or 180 of FIG. 10) may enter the air heating conduit 243 as shown in FIG. 13. Additionally, air from the rear air space will be blown behind and over top of the manifold 252 in similar fashion to the air flow in the manifold 52 of FIG. 3.

Figure 14:
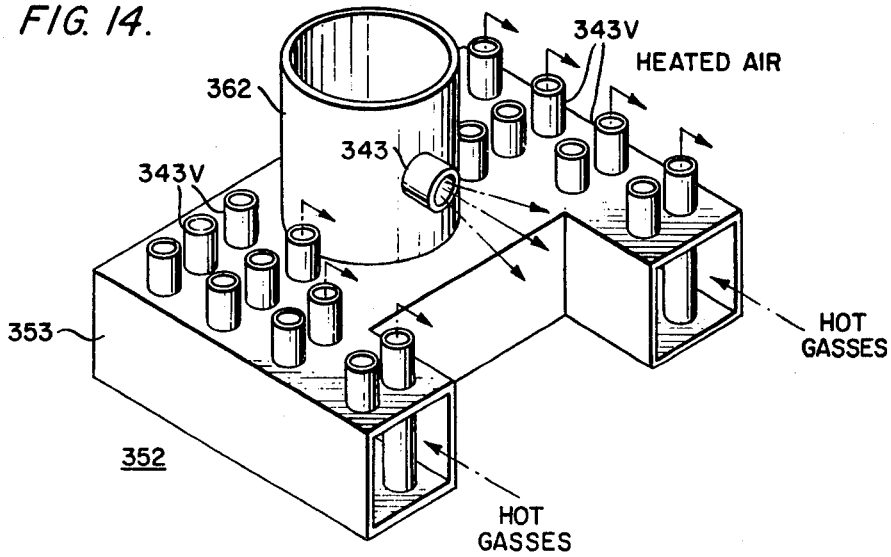
FIG. 14 shows a perspective view of a fifth embodiment of a heat extracting manifold.

Turning now to FIG. 14, a fifth embodiment of the heat extracting manifold will be discussed. In particular, heat extracting manifold 352 includes a body portion 353, inlet projecting portions 354 and 356 having corresponding inlet holes 354H and 356H, outlet conduit 362, and air heating conduit 343, all of which function identically to the corresponding components numbered in the 200 series for the manifold 253 of FIGS. 11–13. The air heating conduit 343 may include heat conducting fins (not shown) similar to the fins 245 shown in FIG. 13. Additionally, the manifold 352 includes a number of vertical air heating conduits 343V which extend through the interior of the manifold 352. The air heating conduits 343V receive cold air at their lower ends from a rear air space (e.g., similar to air space 80 of FIG. 3) and heat the air prior to its exiting out of the upper ends. Although not shown, it will be readily appreciated that the air heating conduits 343V may include a number of heat conducting fins either similar to the fins 245 of FIG. 13 or similar to the heat conducting fins 145 of FIG. 8.

Figure 15:
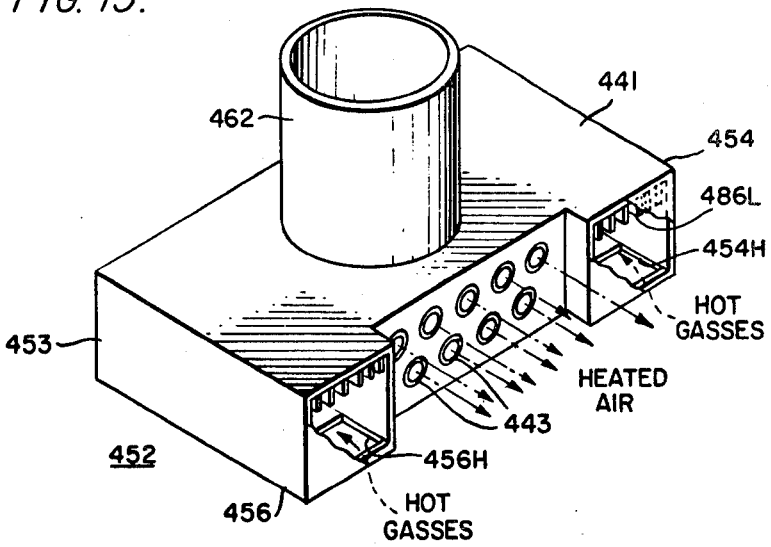
FIG. 15 shows a perspective of a sixth embodiment of a heat extracting manifold.
Figure 16:
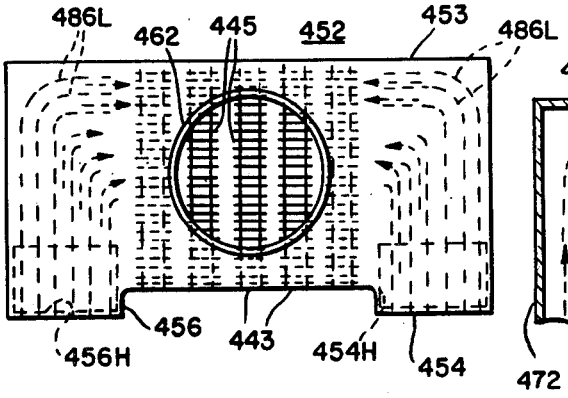
FIG. 16 shows a top view of the manifold of FIG. 15.
Figure 17:
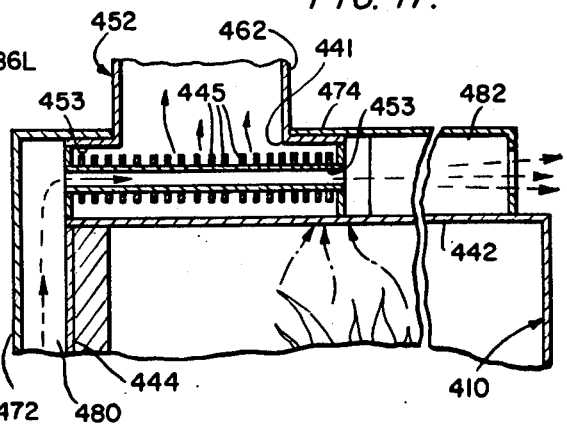
FIG. 17 shows in break-away side cross section view of the manifold of FIG. 15 installed in a wood burning stove.

Turning now to FIGS. 15, 16 and 17, there is shown a sixth embodiment of a heat extracting manifold 452. FIG. 15 shows a perspective view of the heat extracting manifold 452, FIG. 16 shows a top view of the manifold 452, and FIG. 17 shows a side view in cross section of the manifold 452 installed in a wood burning stove.

The manifold 452 includes a body portion 453 and first and second inlet projecting portions 454 and 456 having corresponding inlet holes 454H and 456H both of which face downwardly. Two horizontal rows of air heating conduits 443 extend through the manifold 452 and are arranged in staggered fashion as shown in FIG. 15. For simplicity's sake, FIG. 16 and FIG. 17 show only the air heating conduits of one of the horizontal rows. As shown in FIGS. 16 and 17 the air heating conduits 443 include a number of heat conducting fins 445 disposed thereon.

A number of heat conducting strip fins 486L are disposed on the underside of the planar top wall 411 of the manifold 452. As best shown in FIG. 16, the heat conducting strip fins 486L are curved inwardly towards the outlet conduit 462 centrally disposed on the manifold 452. By curving the fins 486L inwardly, the combustion gases which enter holes 454H and 456H are channeled towards the outlet conduit 462 as indicated by the arrows. The heat conducting fins 486L have been deleted from FIG. 17 for simplicity's sake to better illustrate the air heating conduit 453 and associated fins 445.

As shown in FIG. 17, air from a rear air space 480 would pass through the air heating conduits 453 into a top air space 482. As air proceeded through the air heating conduit 453 it would be heated by combustion gases passing from the inlet holes 454H and 456H to the outlet conduit 462. A blower fan (not shown in FIG. 17) similar to the fan 85 of FIG. 3 may be used to push air through the air heating conduits 453. Although not shown in FIG. 17, a number of heat conducting fins similar to fins 189 of FIG. 8 may be used to heat the air as it passes from the air heating conduits 453 to the heated air outlet 474H. Additionally, upper wall 441 may include a number of heat conducting fins similar to fins 186 of FIG. 7, in which case the auxiliary top wall 474 would be raised slightly relative to the top wall 442 (FIG. 17) such that air from rear air space 480 would pass into the top air space 482 above the heat extracting manifold 452 in addition to passing through the air heating conduits 453.

Figure 20:
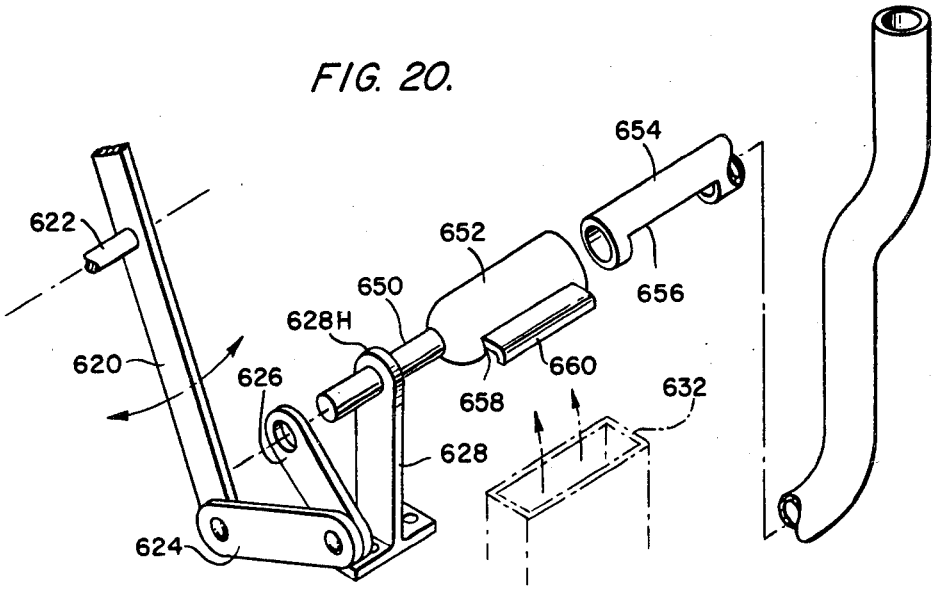
FIG. 20 shows an exploded perspective view of the valve and control arrangement.
Figure 18:
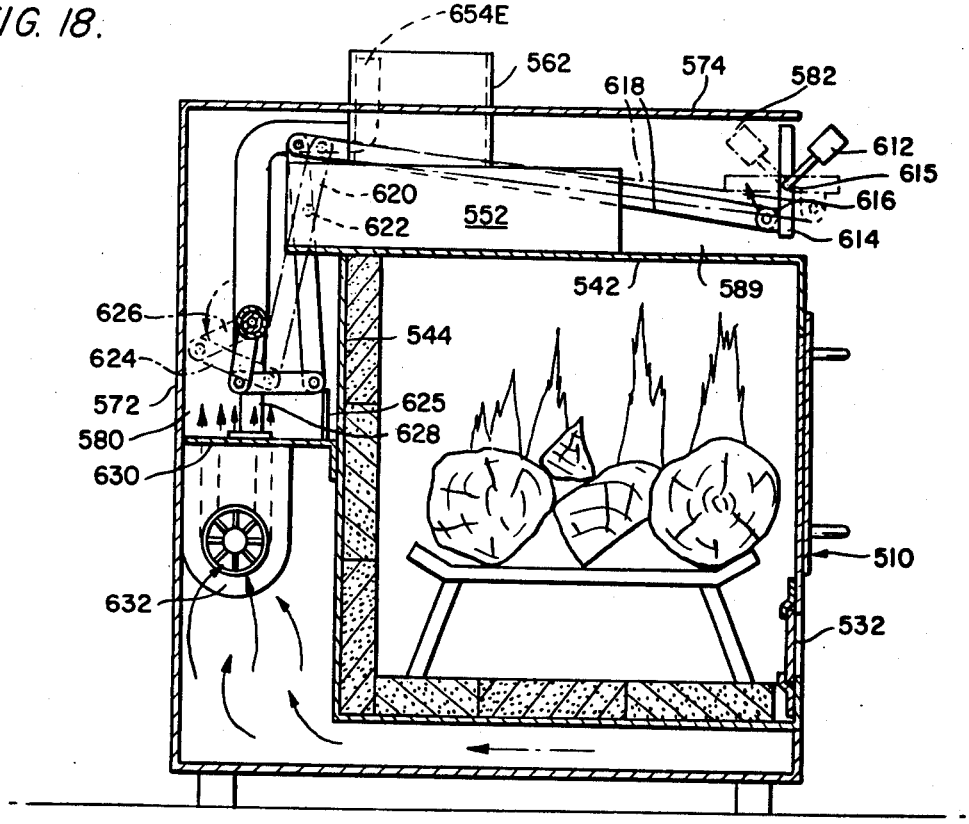
FIG. 18 shows a side cross section view of a wood burning stove showing a flue clearing and output heat regulating feature according to the present invention.
Figure 19:
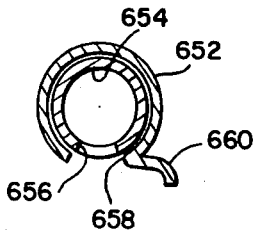
FIG. 19 shows a cross section view of a valve used in the stove of FIG. 18.
Figure 21:
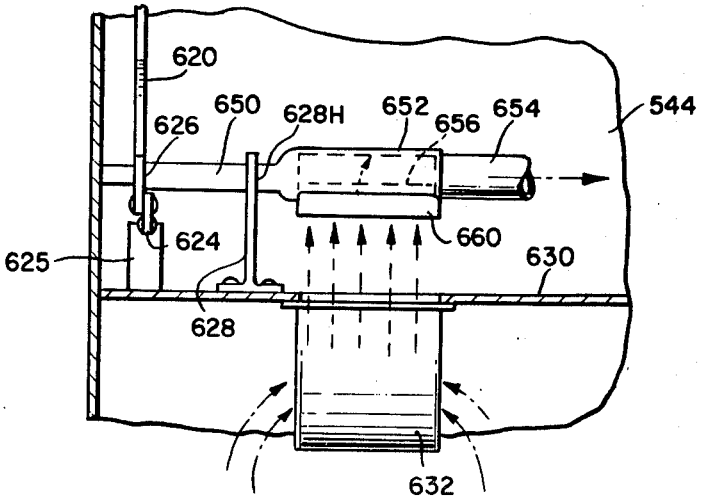
FIG. 21 shows a rear view of the wood burning stove of FIG. 18.

Turning now to FIGS. 18–21, a heat regulating and combustion gas back flow prevention system will be discussed. FIG. 18 shows a side cross section view of a wood burning stove with a flue clearing and output heat regulating system according to the present invention. FIG. 19 shows a cross section view of a valve used in the control system. FIG. 20 shows an exploded perspective view of the valve and associated control arrangement, whereas FIG. 21 shows a rear view of the wood burning stove of FIG. 18.

The wood burning stove 510 includes top wall 542, back wall 544, auxiliary back wall 572, auxiliary top wall 574, rear air space 580, top air space 582, and heat extracting manifold 552 which function in the same manner as the corresponding parts previously discussed and, therefore, need not be discussed in detail. Instead, emphasis will be placed on those components labeled in the 600 series which relate to the heat regulating and flue clearing control system of the present invention. In particular, a handle or manually operable member 612 is attached to cause a heat regulating damper 614 to rotate between a closed position (solid lines in FIG. 18) and an open position (dotted lines in FIG. 18). The damper 614 would be mounted for pivotal rotation in shell sidewalls (not shown in FIG. 18, but similar to those side walls in phantom lines in FIG. 2). Attached to the back of damper 614 is a mounting flange 616, which in turn is pivotally attached to a push rod linkage 618. The linkage 618 is pivotally connected at its other end to a linkage 620 which is secured to the shell side wall (not shown) at a central mounting point 622. The mounting point 622 is attached to allow pivotal motion of the linkage 620 relative to the shell sidewall such that reciprocation of the push rod 618 causes rotation of the linkage 620. The linkage 620 is pivotally connected to a linkage 624 at its other end. The linkage 624 in turn is pivotally connected to a linkage 626 which will be welded or otherwise attached to a stem 650 of a sleeve 652. The stem 650 would extend through a hole 628H in a mounting flange 628 which rests on the horizontal wall 630. Fan 632 is mounted to the underside of the wall 630. Alternately, two fans could be mounted on the wall 630.

Continuing to consider FIGS. 18, 19 and 21, but concentrating on the exploded perspective view of FIG. 20, the valve structure of the present invention will be discussed in detail. In particular, the sleeve 652 is disposed around the end of a pipe 654. Although the pipe 654 is preferably sealed at its end adjacent the mounting flange 628, the pipe 654 includes an entry hole 656 for flue clearing air which may be blown out of the fan 632. The sleeve 652 includes a side opening 658 with a hooded portion 660 disposed immediately adjacent thereto. The pipe 654 extends up into the outlet conduit 562 of the heat extracting manifold 552 to an outlet end 654E.

The operation of the heat regulating system will now be discussed. Upon initial startup of a wood burning stove such as 510, there are two problems which frequently occur. In particular, the fire may not initially output enough heat to warm the air circulated by the fan or fans 632. Additionally, a column of cold air may be disposed in the flue which would be immediately above the outlet conduit 562. This column of cold air may impede the flow of combustion gases out the flue and cause a pressure buildup which could lead to combustion gases escaping out air inlet 536 or other parts of the stove 510.

The heat regulating system shown in FIGS. 18–21 is operative to overcome these two problems during startup. Immediately before or immediately after starting up the fire in the combustion chamber of stove 510, the handle 612 is rotated 90° such that the damper 614 also rotates 90° from the dotted line open position of FIG. 18 to the solid line closed position of FIG. 18. The handle 612 is attached to rotate the shaft 615 and the damper 614 rotates with the shaft 615. As the damper 614 is rotated to the solid line position of FIG. 18, the push rod linkage 618 pushes on the rotating linkage 620 causing it to rotate counterclockwise (as seen in FIG. 18) until the lower part of linkage 620 hits into the stop plate 625 mounted on the wall 630. The movement of linkage 620 in a counterclockwise direction causes linkage 624 to rotate linkage 626 in a counterclockwise direction about the hole 628H. The rotation of linkage 626 in turn causes stem 650 and sleeve 652 to rotate until side opening 658 is lined up with the entry hole 656 (see especially FIG. 20). The fan blower 632 may be turned on immediately after starting the fire. A portion of the air from the blower fans 632 will proceed from the rear air space 580 to the top air space 582 in the manner discussed above. This air will be heated by the heat extracting manifold 552 as well as the fins 589 on top wall 542. Because the damper 614 is closed, the heated air will exit between the damper 614 and the top wall 542.

At the same time as a portion of the air from the blower fan or fans 632 is being heated and exiting below the damper 614, a flue clearing portion of the air from the blower fan or fans 632 will proceed into the pipe 654 by way of the entry hole 656. Additionally, the deflector 660 on the sleeve 652 will increase the amount of air which enters the entry hole 656. This air which goes into the pipe 654 will proceed up that pipe into the outlet conduit 562 where it will create an upward pressure on any column of cold air which may disposed within the flue. By blowing this portion of air up the flue, the resistance of the flue to upward flow of the hot combustion gases will be minimized. Even if the fire starts out with a small amount of hot combustion gases, the blower fan 632 will help the natural tendency of these combustion gases to rise and push out the column of cold air which is initially disposed within the flue. In the absence of the blower fan 632 and the valve comprised of the sleeve 652, pipe 654, and associated parts, it might take several minutes before the fire has achieved enough heat that the hot combustion gases could push out the column of heavy cold air disposed within the flue.

In addition to helping to clear the flue, the valve comprising sleeve 652, pipe 654, and associated parts lower the amount of air circulated around the heat extractor 552. That is, because some of the air leaving the blower fan or fans 632 will proceed up the pipe 654, less air will be circulated through and/or past heat extracting manifold 552 than would otherwise be the case. The heat extracting manifold 552 could of course be any of the manifolds previously discussed. Accordingly, even though the fire is initially putting out a lower amount of heat, it will generally be sufficient to heat the smaller amount of air circulated in heat transfer relationship with the heat extracting manifold 552. Furthermore, the damper 614 will initially limit the air output by the stove to a smaller amount of air than the air circulated by the stove when the valve (sleeve 652 and pipe 654) is closed and the damper 614 is open. As the fire grows in intensity one may gradually rotate the damper 614 from the solid position of FIG. 18 to the dotted position of FIG. 18. Simultaneous with the rotation of the damper 614, the linkages will cause the sleeve 652 to rotate relative to the pipe 654. The rotation of the sleeve 652 will gradually diminish the effective area of the entry hole 656, thereby adjusting the ratio of air blown through the pipe 654 relative to the air exiting the front of the stove 510. The diminution of the effective size of the entry hole 656 will best be appreciated by reference to FIG. 19 showing a cross section end view of the pipe 654 disposed within the sleeve 652. In FIG. 19, the valve comprised of sleeve 652 and pipe 654 is in an open position. Counterclockwise rotation of the sleeve 652 as will be caused by the linkage 626 will gradually block an increasing portion of the hole 656 until the hole is completely blocked by the sleeve 652 which would correspond to a valve closed position.

As should be apparent from the foregoing description, the heat extracting manifolds provide substantially unobstructed passage for the cold air which is heated by the extraction of heat from the combustion gases which would normally be wasted. The efficiency of the foregoing arrangement is manifested by the fact that with the stove in operation in accordance with the invention, the flue is normally warm to the feel of the hand, but can be grasped without danger of being burned.

While the present invention has been illustrated and described in detail, it will be readily apparent to those skilled in the art that various modifications and adaptations may be made. Accordingly, the foregoing description is considered as illustrative only of the principles of the invention. Numerous modifications and changes will be obvious to those skilled in the art. The invention is not limited to the exact construction and operation shown and described. Instead, the invention is defined by the appended claims.

What is claimed is:

1. A heating stove comprising:

a combustion chamber having front, back, top, bottom and side walls;

an outer shell at least partially enclosing said combustion chamber including an auxiliary back wall spaced from said back wall to provide a first rearward air space between said back wall and said auxiliary top wall spaced from said top wall to provide a second air space between said top wall and said auxiliary top wall for passage of heated air into a room to be heated;

a heat extracting manifold mounted to at least one wall of said combustion chamber for transferring heat from combustion gasses to air;

a blower for blowing air to flow in heat transfer relationship with said heat extracting manifold, said blower supported by said outer shell;

a hot air outlet from said outer shell allowing heated air to exit from said wood burning stove;

a flue outlet from said outer shell for allowing combustion gasses from said combustion chamber to pass to a flue;

control means supported by said outer shell and operable to cause a flue clearing portion of air blown by said blower to proceed out said flue outlet, the flue clearing portion of air proceeding out the flue to minimize any back flowing of combustion gases which might otherwise be caused by a column of cool air in the flue; and a valve controlled by said control means and wherein the opening of said valve by operation of said control means allows at least some air blown by said blower to proceed out said flue outlet; and wherein said valve includes a blocking member and a pipe having an entry hole for flue clearing air, said entry hole in a path of blown air from said blower, and said pipe leads air blown in said entry hole to proceed out said flue outlet and said blocking member is controlled by said control means to selectively block air from entering said entry hole.

2. The heating stove of claim 1 wherein said entry hole is in a side of said pipe and said blocking member is a sleeve disposed around a portion of said pipe and having a side opening and said control means opens said valve by lining up said side opening with said entry hole and closes said valve by causing angular displacement between said side opening and said entry hole.

3. The heating stove of claim 2 wherein said pipe is fixed and said control means opens and closes said valve by rotation of said sleeve.

4. The heating stove of claim 3 wherein said sleeve includes a hood portion adjacent said side opening for deflecting air into said side opening.

5. The heating stove of claim 1 wherein said control means includes a manually-operable member outside of said outer shell and movable to open and close said valve.

6. The heating stove of claim 5 wherein said valve includes a blocking member and a pipe having an entry hole for flue clearing air, said entry hole in a path of blown air from said blower, and said pipe leading air blown in said entry hole to proceed out said flue outlet, and said blocking member is movable to open and close said valve by movement of said manually-operable member.

7. The heating stove of claim 5 wherein said entry hole is in a side of said pipe and said blocking member is a sleeve disposed around a portion of said pipe and having a side opening, and said control means further includes a linkage between said manually-operable member and said sleeve to open and close said valve by rotation of said sleeve.

8. The heating stove of claim 1, 2, 5, or 7 wherein said control means controls a damper which regulates flow of heated air out of said hot air outlet.

* * * * *

UNITED STATES PATENT AND TRADEMARK OFFICE

CERTIFICATE OF CORRECTION

PATENT NO. : 4,455,995

DATED : June 26, 1984

INVENTOR(S) : Matthew W. Homolik

It is certified that error appears in the above-identified patent and that said Letters Patent is hereby corrected as shown below:

In Column 13, Line 39 (line 7 of claim 1), after "and said" insert --auxilary back wall for passage of air to be heated, and an--

Signed and Sealed this

*First* Day of *January 1985*

[SEAL]

*Attest:*

*Attesting Officer*

GERALD J. MOSSINGHOFF

*Commissioner of Patents and Trademarks*